United States Patent [19]

Bennett

[11] 4,182,465

[45] Jan. 8, 1980

[54] MANUALLY OPERATED PUMP USING HOLLOW FLEXIBLE MEMBER AS PUMPING CHAMBER

[76] Inventor: Robert A. Bennett, 170 Sturbridge Rd., Easton, Conn. 06425

[21] Appl. No.: 914,397

[22] Filed: Jun. 12, 1978

[51] Int. Cl.[2] ..... B65D 37/00; F04B 43/08

[52] U.S. Cl. ..... 222/207; 222/214; 417/478

[58] Field of Search ..... 417/478, 479, 480; 222/207, 209, 210, 214

[56] References Cited

U.S. PATENT DOCUMENTS

| | | | |
|---|---|---|---|
| 3,749,290 | 7/1973 | Micallef | 222/207 |
| 3,986,644 | 10/1976 | Grogar et al. | 222/207 |
| 3,995,774 | 12/1976 | Cooprider et al. | 222/207 |
| 3,995,776 | 12/1976 | Micallef | 222/207 |
| 4,101,057 | 7/1978 | LoMaglie | 222/207 |
| 4,138,038 | 2/1979 | Grogar | 222/207 |

*Primary Examiner*—Richard E. Gluck

[57] ABSTRACT

A manually operative pump connected to a container having liquid therein to enable the liquid to be discharged as a spray employs a hollow pistol-shaped housing. Liquid is pulled up through an opening in the bottom of the handle and is discharged as a spray via an opening in the free end of the barrel. A hollow flexible member open at both ends extends in the housing from the handle into the barrel and is held in position by curved internal guides. The member has a flexible wall defining a variable volume pump chamber adapted to assume a fully distended position of maximum volume and a collapsed position of lesser volume. A manually operable trigger pivotally secured to the barrel can be pressed into an opening in the barrel and an aligned opening in the guides to engage the wall and change the volume of the chamber. A horizontally elongated poppet is disposed in the end of the member adjacent the free end of the barrel and has an off-center opening connected by a channel to the barrel opening. The poppet also has a longitudinal groove connected to the off-center opening. When the member is in the collapsed position, liquid can flow through the member and a groove and the spray is produced. When the member is fully distended, passage of liquid between the member and groove is blocked.

8 Claims, 21 Drawing Figures

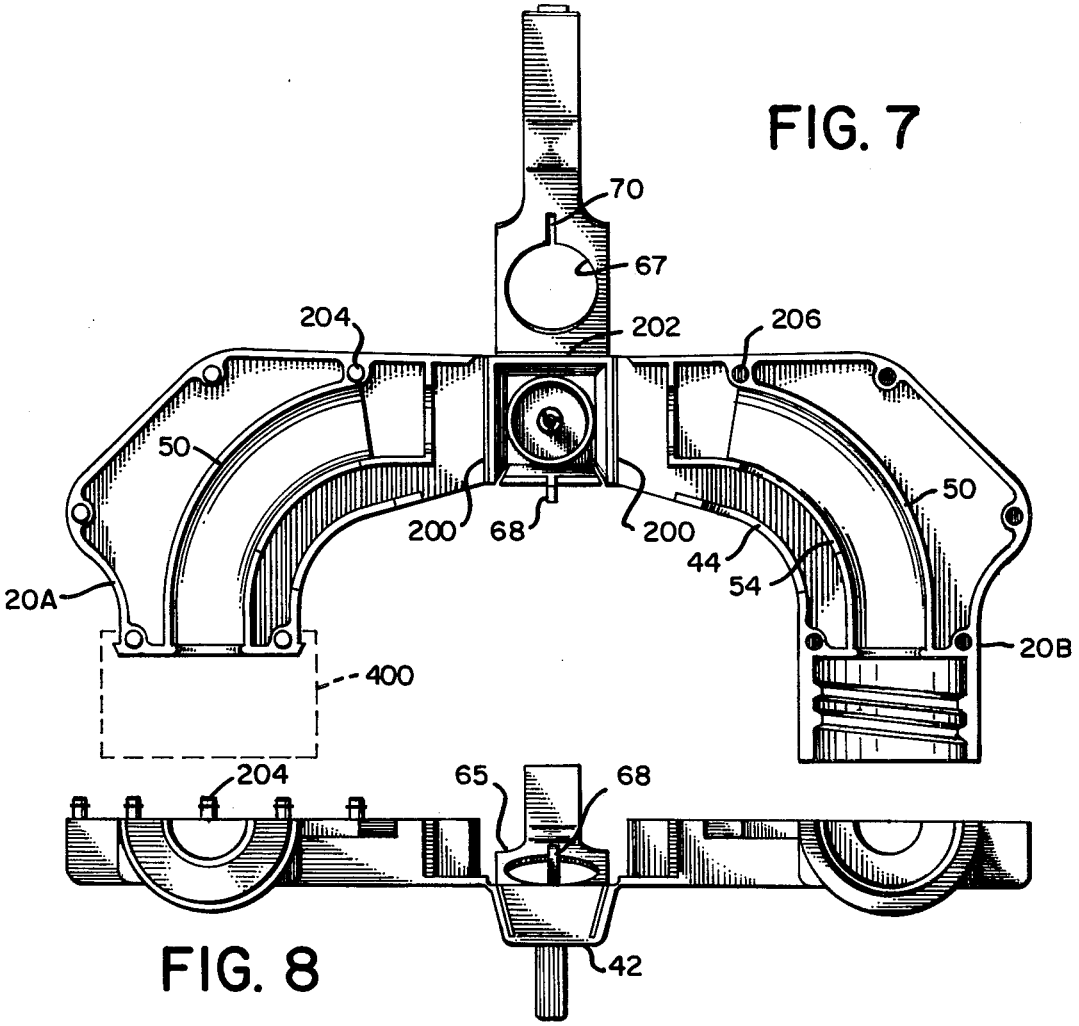
FIG. 7
FIG. 8
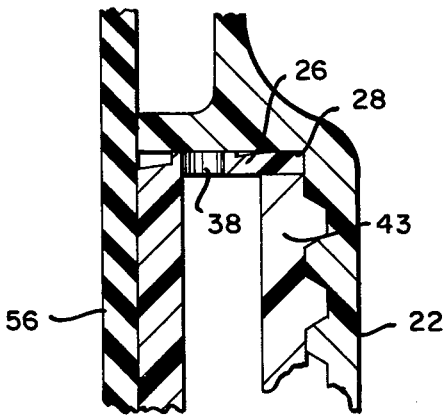
FIG. 16
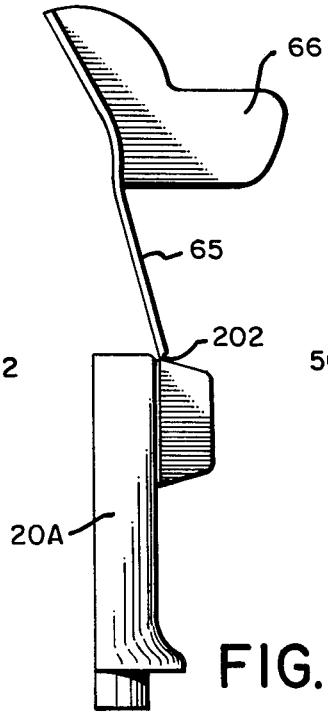
FIG. 9
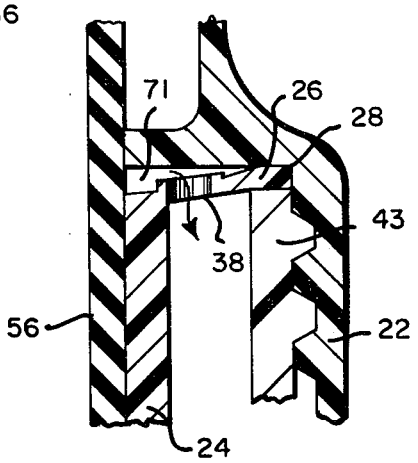
FIG. 17

MANUALLY OPERATED PUMP USING HOLLOW FLEXIBLE MEMBER AS PUMPING CHAMBER

PRIOR ART STATEMENT

U.S. Pat. Nos. 2,527,614 and 3,749,290 disclose manually operative pumps employing hollow tubular members with flexible walls which have fully distended positions of maximum volume and collapsed positions of lesser volume together with inlet and outlet valves at opposite ends of the member and different arrangements for introducing air into the liquid carrying containers associated with the pumps for replenishing the volume of liquid dispensed as sprays. The present invention employs different types of valves differently located with different methods of introducing air, resulting in a more efficient, less expensive, more reliable pump with a greatly reduced number of parts.

BACKGROUND OF THE INVENTION

Disposable liquid spray dispensers are widely used. Typically such dispensers employ a liquid carrying container with a manually operable pump connected thereto. Known pumps utilize a relatively large number of parts, are relatively expensive to produce, and are often unreliable in operation. The present invention is directed toward a pump which is extremely reliable in operation, which can be produced relatively inexpensively, and which employs very few parts.

SUMMARY OF THE INVENTION

A manually operable pump, in accordance with this invention, is adapted for connection to a container having liquid therein to enable said liquid to be discharged therefrom as liquid or in spray form. The pump utilizes a hollow housing having the general shape of a pistol with a vertical handle having a first opening in the bottom thereof and a barrel extending upward and outward from the top of the handle to a free end having a second opening therein. The barrel has a lower surface with a third opening therein disposed between the free end of the barrel and the handle. The housing contains hollow curved guide means therein extending between a starting position in the handle adjacent the first opening and an ending position adjacent the second opening. The means is essentially horizontal in the region adjacent the ending position. The guide means has a fourth opening adjacent the third opening, the first opening being adapted to receive the upper open end of a vertical dip tube which extends into the container below the liquid level.

A hollow tubular member open at both ends has a flexible wall defining a variable volume pump chamber adapted to assume a fully distended position of maximum volume and a collapsed position of lesser volume. This member is disposed in the housing within said means. The member has a vertical end extending below the starting position adjacent the second opening and a horizontal end extending past the ending position.

A manually operable trigger is pivotally secured to the barrel. The trigger has a rest position at which it is disposed within the third opening and spaced from the fourth opening and the member. The trigger also has an operative position at which it extends through the third and fourth opening to engage the flexible wall. The member is fully distended when the trigger is in the rest position and is collapsed when the trigger is in operative position.

A horizontally elongated poppet has an open end and a closed end with an off-center fifth opening. The poppet also has a horizontally elongated longitudinal groove extending from the fifth opening to a point spaced from but adjacent the open end. The poppet is disposed in the horizontal end of the member with the fifth opening disposed adjacent but out of alignment with the second opening. The second and fifth openings are interconnected by a channel. The horizontal end of the member is longitudinally sealed to said poppet when the member is fully distended, whereby passage of liquid from said member to said groove is blocked. The member cooperates with said groove when the member is collapsed to cause liquid in the member to be passed along said groove through the off-center fifth opening, channel and second opening and is discharged therefrom as a spray.

Valve means in the housing cooperates with the first opening and the vertical end of the member to block upward passage of liquid from the first opening into the member when the member is distended and to allow liquid to pass upwardly from the first opening into the member when the member is collapsed.

Air flow means in the handle permits ambient air to flow through the third opening through the housing and the valve means when the member is collapsed but blocks air flow through the valve means when the member is distended.

The housing including the guide means and trigger can be molded as an integral unit in the form of mating body halves, a nozzle section and trigger all integrally interconnected, for example by living hinges. The member, poppet, and valve means are separate components. Thus only a small number of parts are used. Assembly is simple and easy and once the mating halves are snapped together, the resulting pump cannot be accidentally disassembled.

BRIEF DESCRIPTION OF THE DRAWINGS

FIG. 7 is an expanded horizontal view of the molded housing used in the invention.

FIG. 8 is a top view of the housing of FIG. 7.

FIG. 9 is a vertical side view of the housing of FIG. 7.

FIG. 16 is a detail view of a portion of the structure shown in FIG. 5.

FIG. 17 is a detail view of a portion of the structure shown in FIG. 6.

DETAILED DESCRIPTION OF PREFERRED EMBODIMENTS

Figure 1:
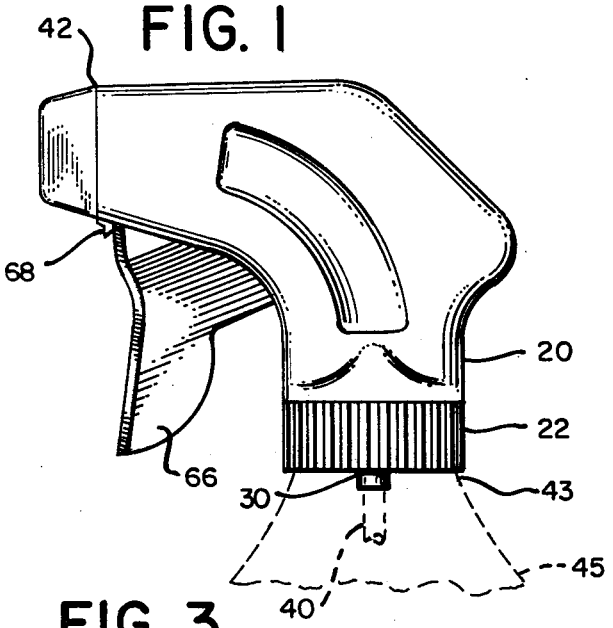
FIG. 1 is a side view of a pump in accordance with the invention.
Figure 2:
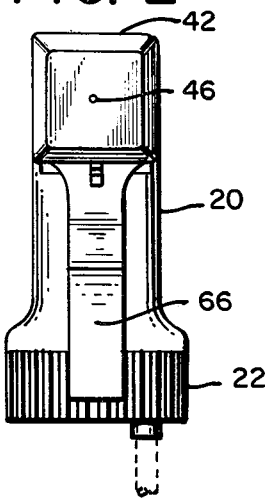
FIG. 2 is a front view thereof.
Figure 3:
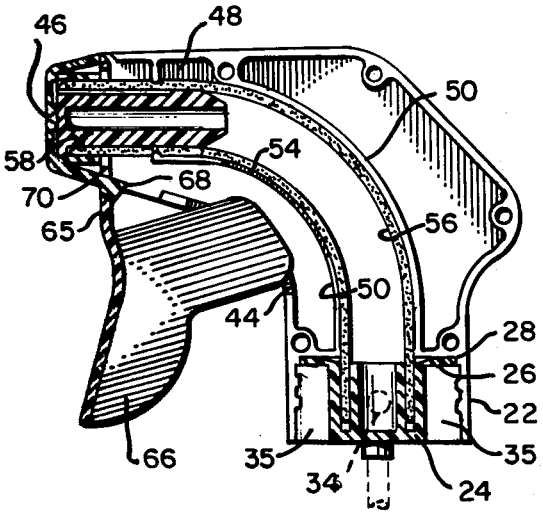
FIG. 3 is a longitudinal vertical cross section thereof with the trigger in locked or storage position.
Figure 4:
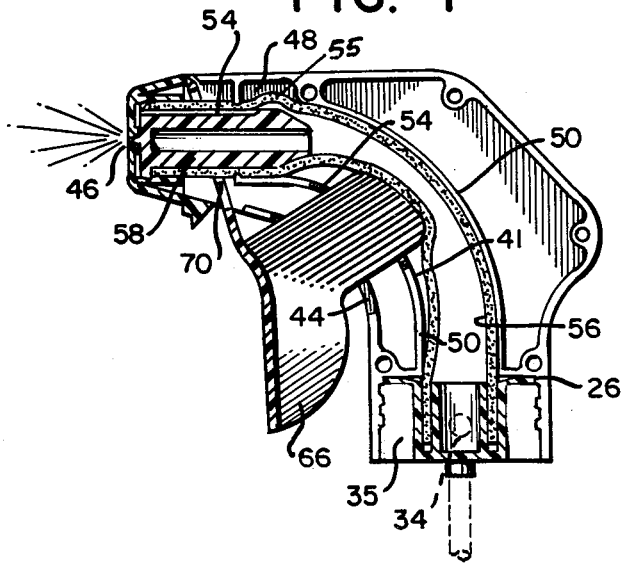
FIG. 4 is a view similar to FIG. 3 but showing the trigger in spray position.
Figure 5:
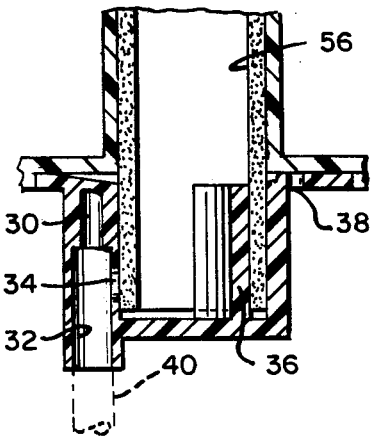
FIG. 5 is a detail, cross-sectional view of one form of inlet valve arrangement used in the invention as shown in closed position.
Figure 6:
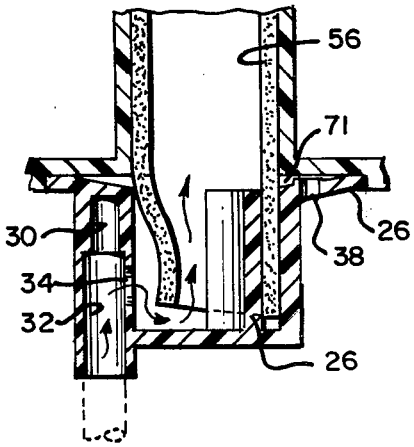
FIG. 6 is a view similar to FIG. 5 but showing the valve arrangement in open position.
Figure 10:
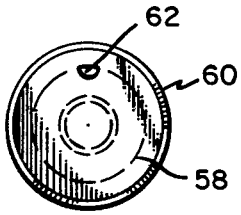
FIG. 10 is a front view of the poppet.
Figure 11:
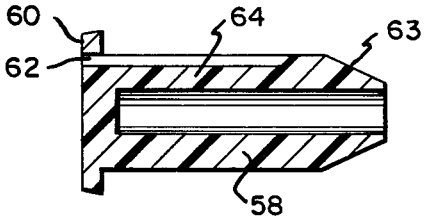
FIG. 11 is a longitudinal vertical cross section of the poppet of FIG. 10.
Figure 12:
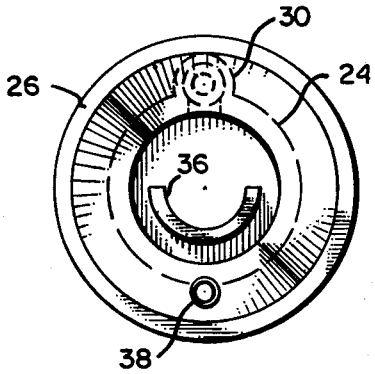
FIG. 12 is a top view of the inlet valve arrangement shown in FIGS. 5 and 6.
Figure 13:
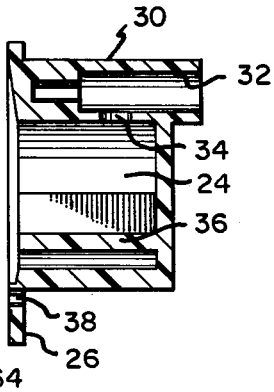
FIG. 13 is a longitudinal vertical cross section of the arrangement of FIG. 12.
Figure 18:
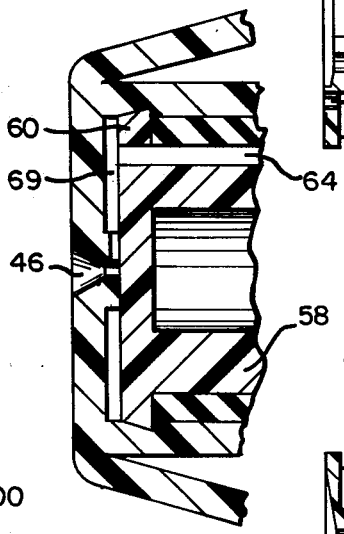
FIG. 18 is a detail view of a portion of the structure shown in FIG. 4.
Figure 14:
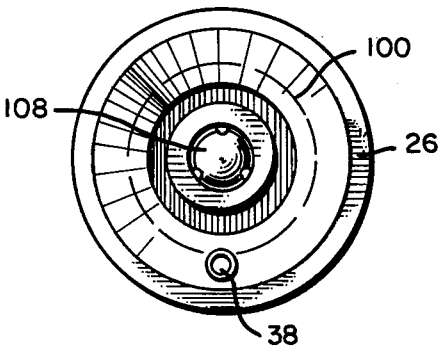
FIG. 14 is a top view of an alternative inlet valve arrangement.
Figure 15:
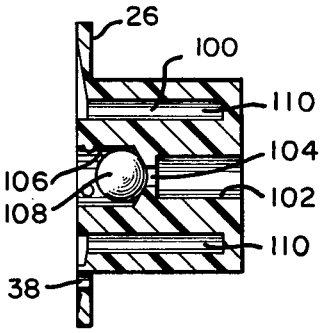
FIG. 15 is a longitudinal vertical cross section of the arrangement of FIG. 14.
Figure 19:
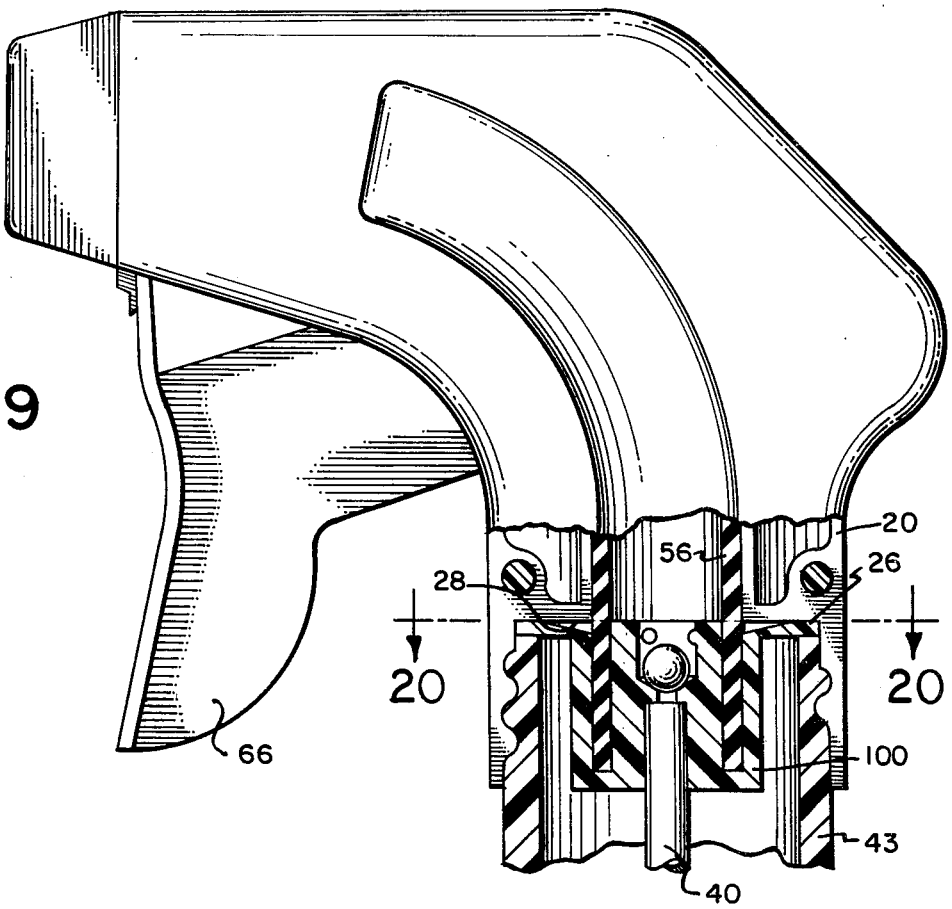
FIG. 19 is a detail cross-sectional view of a modification of the structure of FIG. 5 using the valve of FIGS. 13–15.

Referring first to FIGS. 1–6, 10–13, and 16–18, there is shown a hollow housing in the general shape of a pistol. A vertical hollow handle 20 flares out at bottom to a vertical hollow cylinder 22 open at the bottom. Another cylinder 24 is disposed in cylinder 22. Cylinder 24 has a top disposed horizontally extending flexible flange 26 which is placed with a horizontal circular slot 28 in the upper end of cylinder 22. Flange 26 is slightly beveled so that it extends downwardly and inwardly from its outer edge. Yet another cylinder 30 much smaller in diameter than that of cylinder 24 is secured to and forms part of the wall of cylinder 24. The axes of cylinders 24 and 30 are parallel. Flange 26 has a horizontal opening 38 therein which is disposed outside of the outer wall of cylinder 24 and is disposed oppositely from cylinder 30.

A vertical half section 36 of a hollow cylinder is disposed within cylinder 24 and is spaced from its inner wall. A horizontal line, if drawn between opening 38 and the axis of cylinder 30, would divide section 36 into two equal parts.

Cylinder 30 extends below the closed bottom end of cylinder 24 and has a vertical axial bore 32 extending downward from a point intermediate the top and bottom ends of cylinder 30 to the bottom open end. A dip tube 40 can detachably engage bore 32. Cylinder 30 has a side opening 34 interconnecting the hollow interior of cylinder 24 with bore 32. There is an annular region 35 between cylinder 22 and the cylinder 24 which accommodates and threadly receives the neck 43 of a container 45 with liquid therein.

A hollow nozzle section constituting barrel 42 secured to the top of the handle has a closed free end with central aperture 46 therein and the housing has a lower surface with opening 44 therein. Curved guide means constituting a curved cylindrical channel at 50 extend from a starting position at the upper end of cylinder 22 to an ending position adjacent but spaced from the free end of the barrel. Means 50 has an opening 54 adjacent opening 44.

A hollow elastomeric tube 56 open at both ends and typically made of rubber is disposed in the housing within the channel 50. The vertical end of tube 56 extends into cylinder 24 with a portion of the tube being held between section 36 and the inner wall of cylinder 24. There is a small clearance between the vertical end of the tube and the bottom of cylinder 24. The horizontal end of tube 56 extends almost to the free end of the barrel. The wall of tube 56 is flexible thereby defining a variable volume pump chamber within the tube adapted to assume either a fully distended position of maximum volume and a collapsed position of lesser volume.

An elongated element called a poppet has a horizontally elongated body 58 with a vertical circular outwardly extending front flange 60 which has an offset hole 62 therein. A longitudinal horizontal groove 64 in the outer surface of body 58 is connected at one end to hole 62 and extends rearwards to a point intermediate the front and rear end of body 58 but adjacent the rear end 63. The poppet is disposed within tube 56 with a compressive fit until the flange 60 abuts the horizontal tube end. There is a small clearance forming a channel 69 between the front surface of flange 60 and the inner surface of the free end of the barrel. The upper wall of means 50 has an opening near its forward end which forms a small closed cavity 48 adjacent rear end 63 of the poppet.

A trigger has an extension 65 secured at one end by a living hinge to the interior of the barrel in a region spaced from the means 50 but adjacent the poppet and the tube. The extension has a circular opening 67 through which member 56 passes with suitable clearance. Opening 67 has a vertical slot 70 extending downwards therefrom. The other end of the trigger has a vertically rearwardly extending actuator blade 66 which always extends into opening 44.

When the pump is not in use, the tube is in fully distended position and flexible catch 68 on the barrel wall engages slot 70 to hold the trigger body out of contact with tube 56. When the catch is manually released, the trigger can be manually pulled from its rest position into the operative position at which body 66 extends through openings 44 and 54 to engage the flexible wall of tube 56, thus placing the tube into collapsed position.

Initially, with the tube in fully distended position, the tube is compressively sealed to the poppet and no liquid can flow out of the tube into groove 64 whereby no spray can be discharged from aperture 46. At the same time, the tube 56 seals side opening 34 whereby no liquid can be discharged via the container and dip tube into the tube 56. Finally, the opening 38 is pressed against the top wall of the slot 28 whereby air entering the barrel and housing via opening 44 and opening 54 cannot pass downward through the valve. As a result, the container can be inverted and no liquid will leak out of the barrel.

When the trigger is pulled and the tube is collapsed, the tube cannot bulge at any point along the channel 50 except for cavity 48 where a bulge 55 appears in the wall of tube 56, allowing liquid in the tube to flow around the rear end of the poppet into the groove 64. This liquid under pressure passes through opening 62 into the clearance between the flange 60 and the free end of the barrel and is discharged from the aperture 46 as a spray. At the same time, the flange 26 is flexed downward, producing a small clearance 71 in the slot 28. As the tube is collapsed, ambient air flows through openings 44 and 54 along the gap 41 between the collapsed portion of the tube and the lower guide portion of channel 50 into the slot 28 and then through clearance 71 and opening 38 of flange 26 into the container. The vertical end of tube 56 not constrained between section 36 and cylinder 24 is flexed inwardly, allowing liquid in the container to flow upwardly through the dip tube 40, bore 32 and opening 34 into cylinder 24 and the interior of the tube. Thus the pumping action is produced.

The flap valve arrangement for controlling the flow of liquid into the tube as previously described can be replaced by a ball check valve as shown in FIGS. 14, 15, 19 and 20. Cylinder 100 with flange 26 and opening 38 has a centrally disposed axial bore 102 which extends upwards from the open bottom end through an orifice or valve seat 104 to an enlarged top bore 106 having an open top end in the cylinder. The dip tube can be disposed in bore 102. A metal sphere 108 larger in diameter than the orifice and smaller in diameter than bore 106 is disposed in bore 106. The vertical end of member 56 is disposed in an annular recess 110 centered in cylinder 100. The ball and orifice cooperate to block liquid flow therethrough when the tube is distended and to allow liquid flow therethrough when the tube is collapsed.

FIGS. 7–9 show the one-piece molded item which when folded together after the other parts have been inserted forms the completed pump. Each of two mating handle half section 20A and 20B with interior guides 48 and 50, slot 28, and mating sections of cylinder 22 is secured via a separate living hinge 200 to the tip of nozzle section 42. The extension 62 is also secured to the barrel tip via another living hinge 202. Rivetlike extensions 204 on section 20A snap fit into recesses 206 in section 20B in such manner that the sections cannot be pulled apart once joined. Other integral connections can be used instead of living hinges.

Typically all parts except the tube 56 and sphere 108 (when used) are formed of a suitable plastic.

The fixed cylinder 22 previously described is integral with the rest of the pump whereby the entire pump is rotated to be secured to or removed from a container.

Figure 21:
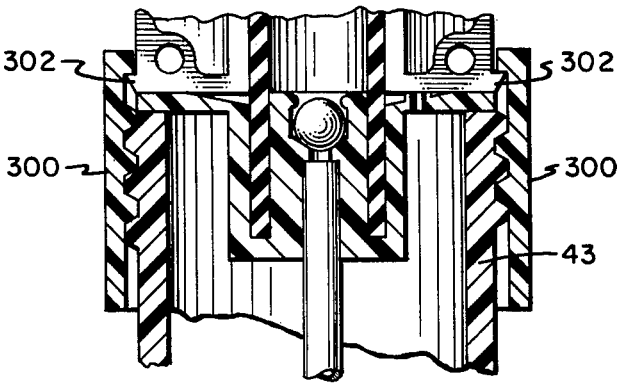
FIG. 21 is a detail view of a modification of the structure of FIG. 19.
Figure 20:
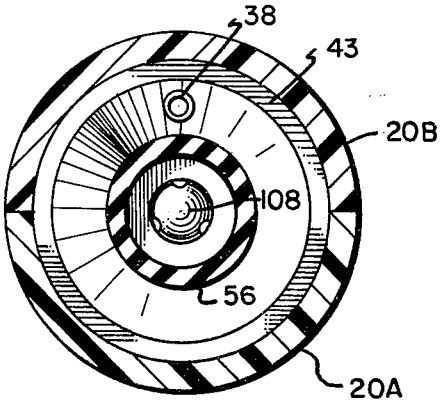
FIG. 20 is a view taken along line 20—20 in FIG. 19.

As shown in FIG. 21 and indicated by the broken line attachment 400 in FIG. 7, the fixed cylinder can be replaced with a rotatable, hollow, vertical cap 300, which since it is somewhat flexible, can be slipped over a tapered outer lip 302 at the base of the mating half sections before the neck of the container is connected. The cap can be rotated while the main part and container are held fixed in position to secure the pump and container together or to release them.

I claim:

1. A pump adapted for connection to a container having liquid therein for discharging liquid therefrom, said pump comprising:

a hollow housing having the general shape of a pistol with a vertical handle having a first opening in the bottom thereof and a barrel extending outward from the top of the handle with a free end having a second opening therein, the barrel having a lower surface with a third opening therein disposed between the free end of the barrel and the handle, the housing containing hollow curved guide means therein extending between a starting position in the handle adjacent the first opening and an ending position adjacent the second opening, the means being essentially horizontal in the region adjacent the ending position and having a fourth opening adjacent the third opening, the first opening being adapted to receive the upper open end of a vertical dip tube;

a hollow tubular member having a flexible wall defining a variable volume pump chamber adapted to assume a fully distended position of maximum volume and a collapsed position of lesser volume, said member being disposed in the housing between said guides, the member having a vertical open end extending below the starting position adjacent the first opening and having a horizontal open end extending past the ending position;

a manually operable trigger pivotally secured to the barrel, said trigger having a rest position at which it is disposed within the third opening and is spaced from the fourth opening and the member, whereby said member is fully distended, said trigger having an operative position at which it extends through the third and fourth opening to engage the flexible wall and collapse said member;

a horizontally elongated poppet element having a front end with an off-center fifth opening and a rear end, said element having a horizontally elongated longitudinal groove extending from the fifth opening to a point intermediate the ends of the element but adjacent its rear end, the element being disposed in the horizontal end of the member with the fifth opening disposed adjacent but out of alignment with the second opening, said second and fifth openings being interconnected by a channel, said member being sealed to the rear end of said element when the member is fully distended whereby passage of liquid from said member to said groove is blocked, said member being spaced from the rear end of the element when the member is collapsed whereby liquid in the member flows along said groove through the off-center fifth opening, channel and second opening to be discharged therefrom as a spray; and valve means in the housing cooperating with the first opening and the vertical end of the member to block downward passage of liquid from the member into the handle through the first opening when the member is contracting and to allow said downward passage when the member is expanding.

2. The pump of claim 1 further including air flow means partially in the handle and partially in the valve means which permits ambient air to flow through the handle and valve means when the member is collapsed but which blocks air flow through the valve means when the member is distended.

3. The pump of claim 2 wherein said member forms a bulge around the rear end of the element to allow passage of liquid from within the member to the groove when the member is collapsed.

4. The pump of claim 3 wherein said trigger has an extension with an opening through which said member passes, said trigger having a body extending through the fourth opening when the trigger is in operative position.

5. The pump of claim 2 wherein said valve means includes a flexible circular flange having a sixth opening disposed off center therein.

6. The pump of claim 5 wherein said handle has an interior circular slot in which said flange is disposed, said slot having a top wall, said flange and sixth opening engaging said top wall when the member is distended, said sixth opening being spaced below said top wall when the member is collapsed.

7. The pump of claim 6 wherein said valve means includes at least one vertical cylinder having said flange at its upper end.

8. The pump of claim 7 wherein the top surface of said flange slopes downwardly and inwardly from its outer periphery.

* * * * *